United States Patent [19]

Pierce et al.

[11] 4,379,179

[45] Apr. 5, 1983

[54] METHOD FOR DETERMINING THE MAGNETIC ANISOTROPY FIELD IN THE MANUFACTURE OF MAGNETIC DOMAIN DEVICES

[75] Inventors: Russell D. Pierce, Randolph; Walter B. Venard, Bernardsville, both of N.J.

[73] Assignee: Bell Telephone Laboratories, Incorporated, Murray Hill, N.J.

[21] Appl. No.: 319,627

[22] Filed: Nov. 9, 1981

[51] Int. Cl.[3] ..... B05D 5/12

[52] U.S. Cl. ..... 427/8; 428/48; 428/128; 428/130; 428/131

[58] Field of Search ..... 427/8, 48, 128, 130, 427/131

*Primary Examiner*—Bernard D. Pianalto

*Attorney, Agent, or Firm*—Peter A. Businger

[57] ABSTRACT

The magnetic anisotropy field in a layer of magnetic material on a substrate is determined by a method involving the application of a magnetic field upon whose release a so-called "sea of bubbles" is observed. The direction of this field typically is at a nonzero angle of elevation relative to the layer.

In accordance with the invention, a preferred angle of elevation is determined upon inspection of a functional relationship between angle of elevation and magnetic field strength associated with the observation of a sea of bubbles. Results obtained by the method compared favorably with results obtained based on magnetic resonance techniques and, since the method is also relatively simple, it is particularly suitable for quality control in the manufacture of magnetic bubble devices.

7 Claims, 4 Drawing Figures

H (KOe)
2.00
1.90
1.80
1.70
1.60
1.50
1.40
3°
2°
1°
0°
1°

$H_K$(Oe)
2200
2100
2000
1900
1800
1700
1600
1500
1500
1600
1700
1800
1900
2000
2100
2200
$H_K$(Oe)

METHOD FOR DETERMINING THE MAGNETIC ANISOTROPY FIELD IN THE MANUFACTURE OF MAGNETIC DOMAIN DEVICES

TECHNICAL FIELD

The invention is concerned with the manufacture of magnetic domain or "bubble" devices and, more particularly, with the determination of the magnetic anisotropy field in layers of magnetic materials as desired, e.g., in manufacturing quality control.

BACKGROUND OF THE INVENTION

Magnetic domain devices are based on the nucleation and propagation of magnetic domains in a layer of magnetic material such as, e.g., a magnetic garnet material deposited on a nonmagnetic garnet substrate. Desired magnetic anisotropy in such a layer results in an "easy direction" of magnetization which is perpendicular to the layer and which renders the layer capable of sustaining magnetic domains whose magnetization is antiparallel to the magnetization of layer material surrounding the domains.

Evaluation of a material for suitability as a magnetic domain material typically involves the consideration of a number of material parameters such as, e.g., saturation magnetization, uniaxial anisotropy, exchange constant, material length parameter, bubble collapse field, anisotropy field, quality factor, coercivity, temperature dependence of the bubble collapse field, lattice parameter, magnetostriction coefficient, and cubic anisotropy as described, e.g., by S. L. Blank et al., "Design and Development of Single-Layer, Ion-Implantable Small-Bubble Materials for Magnetic Bubble Devices", *Journal of Applied Physics*, Vol. 50, No. 3 (March 1979), pp. 2155–2160.

In the following, attention is directed primarily to the determination of the magnetic anisotropy field which is commonly designated as $H_K$ (in units of oersteds) and which may be defined as the weakest magnetic field which is capable of switching the magnetization of a layer from the easy direction perpendicular to the layer to a direction in the plane of the layer.

A standard method for experimentally determining the magnetic anisotropy field is based on ferromagnetic resonance techniques as described by R. C. Le Craw et al., "Temperature Dependence of Growth-Induced Magnetic Anistropy in Epitaxial Garnet Films by Resonance Techniques", *AIP Conference Proceedings* No. 5 (Magnetism and Magnetic Materials—1971), American Institute of Physics, 1972, pp. 200–204. Alternate methods have been proposed which promise to be more expeditious and which are based on the observation of a certain regular pattern of bubbles upon release of an applied magnetic field which then is considered to correspond to the anisotropy field. Such methods have been proposed by a number of authors such as, e.g., A. J. Kurtzig et al., "Noncubic Magnetic Anisotropies in Bulk and Thin-Film Garnets", *IEEE Transactions on Magnetics MAG-7* (1971), pp. 473–476;

A. B. Smith et al., "Uniaxial Magnetic Anisotropy in ErEu-, YEu-, and YGdTm-Garnet Films for Bubble-Domain Devices", *AIP Conference Proceedings* No. 10 (Magnetism and Magnetic Materials—1972), American Institute of Physics, 1973, pp. 309–313;

Y. Shimada, "Domain Patterns of a Magnetic Garnet Bubble Film in an Arbitrarily Oriented Field," *Journal of Applied Physics*, Vol. 45, No. 7, July 1974, pp. 3145–3158;

A. Hubert et al., "Effect of Cubic, Tilted Uniaxial, and Orthorhombic Anisotropies on Homogeneous Nucleation in a Garnet Bubble Film," *Journal of Applied Physics*, Vol. 45, No. 8, August 1974, pp. 3562–3571; and R. Wolfe et al., "Reduction of the Apparent Anisotropy of Bubble Garnet Films under Aluminum Metallization," *AIP Conference Proceedings* No. 29 (Magnetism and Magnetic Materials—1975), American Institute of Physics, 1976, pp. 117–118.

Methods of this latter type have been associated with the term "sea of bubbles" which is descriptive of a preferred bubble pattern as observed upon release of a magnetic field. The above-cited references show that there has been experimentation with regard to the direction in which a magnetic field is applied. Appropriate choice of such field direction is in the interest of a reliable determination of the magnetic anisotropy field, and it was found in some instances that it may be preferable to choose a field direction which deviates by a few degrees from an in-plane direction. What has been lacking, however, is a systematic approach to the optimal choice of an angle of elevation of the magnetic field to achieve reliability comparable to that of a resonance method.

SUMMARY OF THE INVENTION

It is an object of the invention to provide a convenient and reliable method for determining the magnetic anisotropy field of magnetic layers in the manufacture of magnetic domain devices. Such devices are made by depositing on a substrate a layer of magnetic material. At a time after deposition of the layer the magnetic anisotropy field is ascertained, in accordance with the invention, by subjecting the layer to a magnetic field in a direction whose azimuth is predetermined and whose angle of elevation relative to the layer has a preferred value. This preferred value is chosen as follows: A functional relationship is found between the angle of elevation and the strength of a magnetic field having such predetermined azimuth, the condition to be satisfied at each angle of elevation being the observation of a certain desired pattern of magnetic domains in the layer upon release of the field. The desired pattern may be described as a "sea of bubbles" and is exactly or most nearly equal to an array of essentially circular domains. The resulting functional relationship is observed to have an approximately linear portion which is adjacent to a peak corresponding to a maximum of the functional relationship. The preferred angle of elevation is then chosen approximately equal to a value corresponding to minimum slope of the approximately linear portion, and the corresponding magnetic field strength is taken to be proportional to the desired magnetic anisotropy field strength of the layer.

DETAILED DESCRIPTION

Determination of the magnetic anisotropy field is typically carried out after deposition of a magnetic layer of, e.g., a magnetic garnet material on a nonmagnetic garnet substrate by liquid phase epitaxy. This method of deposition is the subject, e.g., of a survey paper by M. H. Randles, "Liquid Phase Epitaxial Growth of Magnetic Garnet", *Crystals for Magnetic Applications*, Springer, 1978, pp. 71–96 which is hereby incorporated by reference.

Figure 1:
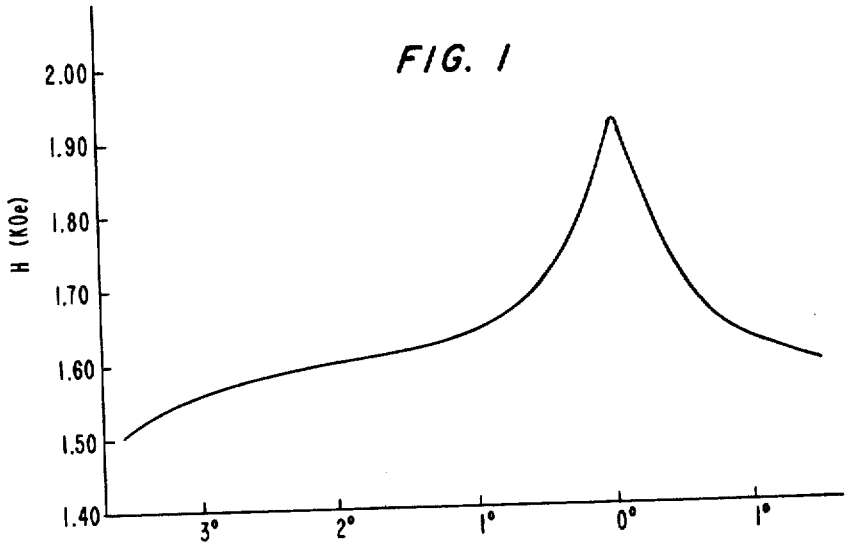
FIG. 1 is a graphical representation of a functional relationship between angle of elevation of a magnetic field and magnetic field strength such that, upon release of the field, a desired pattern of magnetic domains is observed.
Figure 2:
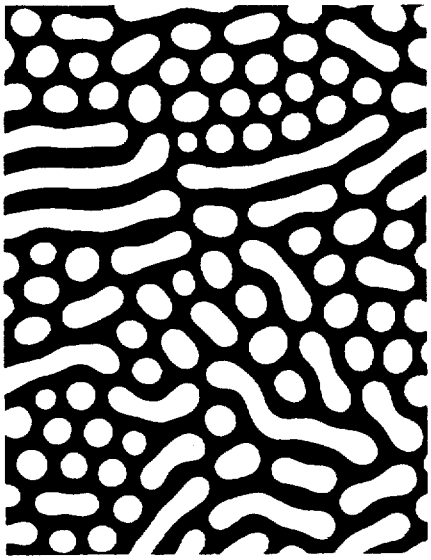
FIG. 2 shows a pattern of magnetic domains upon release of a magnetic field when an applied magnetic field strength is significantly less than the strength of a desired field.
Figure 3:
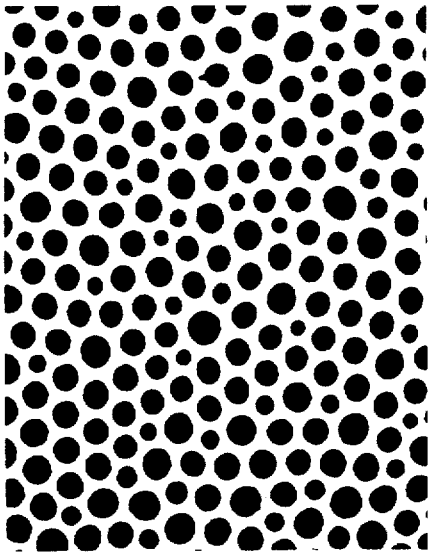
FIG. 3 shows a pattern of magnetic domains as desired upon release of a magnetic field in the determination of magnetic anisotropy in accordance with the invention.

FIG. 1 shows the graph of a functional relationship between an angle of elevation (in degrees) and a magnetic field (in thousands of oersteds). The graph is obtained by repeated application of a magnetic field to a layer of magnetic domain material, the azimuth of the field being essentially fixed, and the angle of elevation relative to the layer being variable. To each angle of elevation there corresponds a field strength which is obtained as the weakest magnetic field such that, upon its release, a magnetic domain pattern is observed which most nearly has an essentially regular appearance as shown in FIG. 3. This is in contrast to a more irregular appearance, e.g., as shown in FIG. 2. The degree of achievable regularity may vary depending on the angle of elevation; in particular, greater irregularity was found to prevail at angles at or near an angle corresponding to a peak value of field strength in the functional relationship.

The resulting curve shows a peak which is flanked by a relatively flat portion having essentially constant slope; in FIG. 1 this portion is centered at an angle of approximately 2 degrees. In accordance with the invention such angle corresponding to essentially constant scope is adopted as a desired angle of elevation, and the corresponding field is taken to be proportional to the magnetic anisotropy field. The constant of proportionality may conveniently be determined by calibration upon comparison, e.g., with a value of the magnetic anisotropy field as obtained by a magnetic resonance technique. In the manufacture of magnetic devices such calibration is carried out for a representative specimen of a series of substrates on which magnetic layers have been deposited having the same nominal composition. (For long series, occasional checking of this calibration is advisable.) All magnetic field measurements are preferably carried out at a common temperature which preferably varies by not more than plus or minus 2 degrees C. relative to a nominal temperature.

Figure 4:
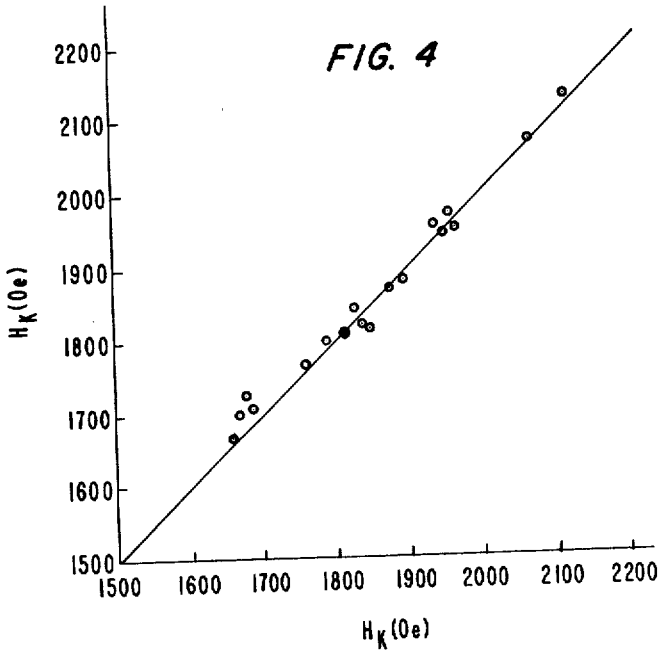
FIG. 4 graphically shows magnetic anisotropy field strength as determined in accordance with the invention in comparison with magnetic anisotropy field strength as determined by a prior art standard method.

FIG. 4 illustrates a desired benefit of the invention. Applied on the vertical axis is anisotropy field strength as determined by a prior-art reference method based on magnetic resonance techniques, and applied on the horizontal axis is anisotropy field strength as determined by the method of the invention using magnetic field pulses. Each point or circle in FIG. 4 corresponds to a specimen and a calibration specimen is emphasized by a darkened circle. It can be seen that these points lie close to the 45-degrees line drawn through the point corresponding to the calibration specimen; accordingly, good agreement is realized between the anisotropy field values as determined by the new method and by the reference method. Such reliability of the method in accordance with the invention is considered to be particularly advantageous in the presence of an interface layer as disclosed, e.g., in M. Kestigian et al., "Magnetic Inhomogeneities in $(YSmCa)_3(GeFe)_5O_{12}$ and their Elimination by Improved Growth Procedures," *Materials Research Bulletin*, Vol. 11 (1976), pp. 773–780. Such interface layer is understood to be the result of initial transient growth in the epitaxial deposition process, and the peak as illustrated by FIG. 1 is believed to be the higher the greater the compositional inhomogeneity in a deposited layer. However, even in the presence of such inhomogeneity due to the presence of the interface layer, the disclosed method was found to reliably measure the anisotropy field of the essentially homogeneous bulk of the layer.

Implementation of the method as described above may be conveniently based on the use of magnetic field pulses as mentioned above in the description of FIG. 4. The shape of such pulses is not critical; pulses may, e.g., be sinusoidal or square. Pulse duration may be on the order of a few milliseconds; in the interest of accuracy of the method, pulses have a preferred duration of at least 10 microseconds. Furthermore, in the interest of a positive identification of a desired pattern of the kind as depicted in FIG. 3, it is desirable to apply additional magnetic field pulses having a substantial component perpendicular to the layer. The two kinds of pulses may be used in an alternating fashion, the latter kind serving to randomize a magnetic domain pattern prior to application of the former as described above.

EXAMPLE

Sample layers having a thickness of approximately 3 micrometers and a nominal composition as represented by the formula $Y_{1.2}Sm_{.4}Lu_{.5}Ca_{.9}Fe_{4.1}Ge_{.9}O_{12}$ were deposited by liquid phase epitaxy on a gadolinium-gallium garnet substrate. For their evaluation by the method as described above, magnetic fields were used having an azimuth corresponding to a <110>-direction in the (111) magnetic layer. A functional relationship in accordance with FIG. 1 was obtained by experimentally determining a magnetic field as described above at intervals of 0.125 degrees of angle of elevation. Patterns as depicted in FIG. 2 and 3 were observed at a magnification of 250× in a polarizing microscope. Based on the curve as depicted in FIG. 1, an angle of elevation of 2 degrees was adopted as preferred, such angle corresponding approximately to a minimum slope of the curve at a point away from the observed peak.

What is claimed is:

1. A method for making a plurality of magnetic devices, each of said devices comprising a layer of a magnetic material on a substrate, said method comprising depositing said layer on said substrate and ascertaining the magnetic anisotropy field of said layer, such ascertaining comprising (1) subjecting said layer to a magnetic field in a direction having a chosen azimuth and a preferred angle of elevation, and (2) inspecting a magnetic domain pattern produced in said layer upon essential removal of said field, said method being characterized in that said preferred angle of elevation has been determined essentially by (i) determining a functional relationship between a tentative angle of elevation and a magnetic field strength, said tentative angle of elevation being associated with a tentative direction whose azimuth is essentially said chosen azimuth, and said magnetic field strength being the strength of a magnetic test field which is in said tentative direction and which is the weakest field such that, upon essential removal of said magnetic test field, a preferred magnetic domain pattern is produced in said layer, said preferred magnetic domain pattern being equal or most nearly equal, as a function of said magnetic field strength, to an array of essentially circular magnetic domains, and (ii) selecting said preferred angle of elevation to be essentially equal to an angle of elevation corresponding to an essentially linear portion of said functional relationship, said essentially linear portion being adjacent to a peak of said functional relationship.

2. Method of claim 1 in which said magnetic test field is applied as a pulse having a duration which is greater than or equal to 10 microseconds.

3. Method of claim 1 in which prior to an application of said magnetic test field an essentially randomizing field is applied to said layer, said essentially randomizing field having a substantial component in a direction perpendicular to said layer.

4. Method of claim 1 in which said magnetic anisotropy field is essentially proportional to said magnetic field strength.

5. Method of claim 4 in which the factor of proportionality between said magnetic anisotropy field and said magnetic field strength is determined by calibration comprising subjecting said layer to a magnetic resonance technique.

6. Method of claim 1 in which the material of said magnetic layer is a magnetic garnet material.

7. Method of claim 1 in which an interface layer is between said substrate and said magnetic layer.

* * * * *